US005467766A

United States Patent [19]

Ansite et al.

[11] Patent Number: 5,467,766

[45] Date of Patent: Nov. 21, 1995

[54] VALVE FOR A PRESSURE BREATHING SYSTEM WHICH ACCOMPLISHES THE VALSALVA MANEUVER

[75] Inventors: William K. Ansite, Glendale; David N. Pennell, Apple Valley, both of Calif.

[73] Assignee: Gentex Corporation, Rancho Cucamonga, Calif.

[21] Appl. No.: 135,740

[22] Filed: Oct. 13, 1993

[51] Int. Cl.[6] ..... A62B 9/02; A62B 18/02

[52] U.S. Cl. ..... 128/205.24; 128/205.25; 128/207.12

[58] Field of Search ..... 128/201.15, 201.24, 128/206.21, 206.23, 201.18, 201.12, 207.12, 201.23, 201.25, 201.26, 201.27, 203.22, 203.18, 204.26, 206.28, 205.24, 205.25; 73/40

[56] References Cited

U.S. PATENT DOCUMENTS 4,354,520 10/1982 Easley, Jr. ..... 128/207.12 X
4,606,340 8/1986 Ansite ..... 128/205.24
4,667,667 5/1987 Schnoor et al. ..... 128/201.18
4,832,011 5/1989 Busch ..... 128/202.13
4,926,853 5/1990 Meunier ..... 128/201.18
5,299,448 4/1994 Maryyanek ..... 73/40

*Primary Examiner*—Kimberly L. Asher
*Attorney, Agent, or Firm*—Donald D. Mon

[57] ABSTRACT

A pressurized breathing system enabling the execution of the Valsalva maneuver. A breathing mask has an inhalation valve and an exhalation valve. A Valsalva valve when in its normal position does not interfere with the regular performance of the system. When it is activated, it holds the exhalation valve closed. An exhalation effort of the wearer then accomplishes the Valsalva maneuver against the closed inhalation valve.

8 Claims, 2 Drawing Sheets

VALVE FOR A PRESSURE BREATHING SYSTEM WHICH ACCOMPLISHES THE VALSALVA MANEUVER

FIELD OF THE INVENTION

A valve for a pressurized breathing system which interrupts the normal operation of the system to accomplish the Valsalva maneuver.

BACKGROUND OF THE INVENTION

The Valsalva maneuver is known to and used by most pilots and by many knowledgeable air travelers. Its objective is to reduce or to eliminate the pain which is often caused by changes in ambient pressure, usually because of rapid change of altitude.

The problem is grounded in the sluggishness of the sinuses and eustachian tubes for permitting air which is under pressure in the inner ear to leave when ambient pressure is reduced. Air under pressure can readily enter the inner ear, but its exit is slowed by the same passages that permit its more rapid entry. As a consequence, the person can suffer considerable pain as the result of the differential pressure.

These pains can sometimes be relieved by yawning or by stretching the jaws, which favorably affect the sinuses and eustachian tubes to facilitate the exit of air. This is often sufficient for airline and automobile passengers, and for flyers in small aircraft whose rate of change of altitude is relatively small.

However, in the field of high performance aircraft, the rate of climb or descent is often very high, and the amelioration of the problem by means such as yawning is insufficient. For these circumstances, the Valsalva maneuver is a well-known expedient. Of course, it is also useful in less stringent circumstances, and is widely used by pilots and passengers even on low performance craft.

Here it may be observed that this invention is useful in other than vehicular and aircraft environments. In spacecraft and submarine applications, rapid pressure changes are often encountered. This invention is also useful in them.

The purpose of this maneuver is to create a counterbalance pressure to reduce the differential pressure. It is accomplished by pinching the nose closed while keeping the mouth closed, instead of exhaling. However useful, this technique is not available to an airman who is wearing a face mask, and who usually is too busy with his controls to pinch his nose, even if he were not wearing a mask.

At altitudes of most interest to this invention, generally above about 35,000 feet, airmen require assistance in order to breathe. Pressurized breathing systems are known for this purpose. Also, the airman is often provided with pressure suits that keep excessive amounts of blood from going to his feet. As a consequence of these systems, conscious muscular exertion is required for exhalation under many commonly-encountered situations.

In these systems, the airman wears a helmet which carries a face mask. When the mask is in place, it closely fits to his face around his nose and mouth. The volume of the mask is kept small so as to minimize or hopefully eliminate all dead volume. Breathing air is supplied to the mask under pressure through an inhalation valve, and exhaust air is vented from the mask through an exhalation valve. The operation of these valves is entirely in response to the airman's own breathing, which is the reason why conscious exertion is required to exhale against a pressurized system.

Now it will be observed that if the exhalation valve were blocked closed such as by the hand, and the airman consciously tried to exhale, the Valsalva maneuver would be accomplished. One problem is that the exhalation valve is on the mask, at a location not conveniently available to the airman, and which is impeded by other equipment such as the visor and the suspension straps.

It is an object of this invention to make the Valsalva maneuver available to an airman who is wearing a face mask, in a pressurized breathing system by providing a valve which for convenience will be called a "Valsalva valve", and which can be located where it can conveniently be actuated without disturbing other systems such as heads up displays.

It is another object of this invention to provide a control for the Valsalva valve which is conveniently located to the user so he can actuate the valve under physically stringent conditions, such as substantial g loads.

BRIEF DESCRIPTION OF THE INVENTION

A Valsalva valve according to this invention is used in a pressurized breathing system that incorporates an inhalation valve and a compensated valve. These valves control the flow of gases into and out of the mask, and respond to the breathing exertions of the wearer. These valves are diaphragm types, whose operation depends on differential pressures and spring bias loads. The inhalation valve receives breathing gases under pressure and delivers them to the face mask cavity. The exhalation valve discharges to atmosphere from the face mask cavity.

Conduits from the Valsalva valve connect it to the face mask cavity and to a first side of the diaphragm in the exhalation valve which is not exposed to face mask cavity pressure. When the Valsalva valve is actuated, it communicates the cavity pressure to the first side, and as a consequence the exhalation valve will not open at this time. Attempts to overcome this action result in even stronger closure of the exhalation valve.

The above and other features of this invention will be fully understood from the following detailed description and the accompanying drawings in which:

DETAILED DESCRIPTION OF THE INVENTION

Figure 1:
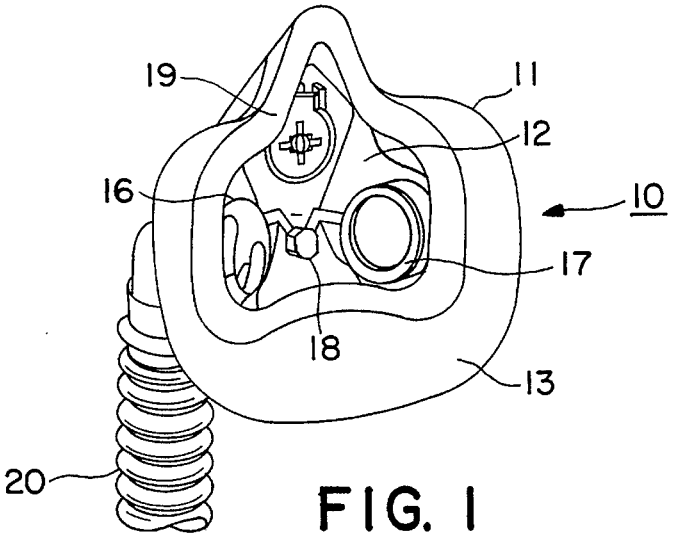
FIG. 1 shows a face mask equipped with a valve according to this invention.

FIG. 1 shows a typical face mask 10 which is fitted against the face of a user, often an airman, to provide him with a pressure breathing system. The mask includes a body 11 which forms a breathing cavity 12 inside a sealing edge 13. The sealing edge is made of conforming material which accommodates itself to the contours of the wearer's face. It is customary for the volume of the cavity to be kept to a minimum, so as to eliminate or at least greatly reduce any dead volume of gases. This is intended to be a region of active flow. The sealing edge surrounds the wearer's mouth and nose, so that airflow through both his nose and mouth are into the cavity. The mask does not surround the ears.

The body 11 of the mask supports and passes an inhalation valve 16, an exhalation valve 17, and a Valsalva valve 18. A microphone 19 is also supported by body 11. The wearer therefore breathes into and out of the cavity.

Figure 2:
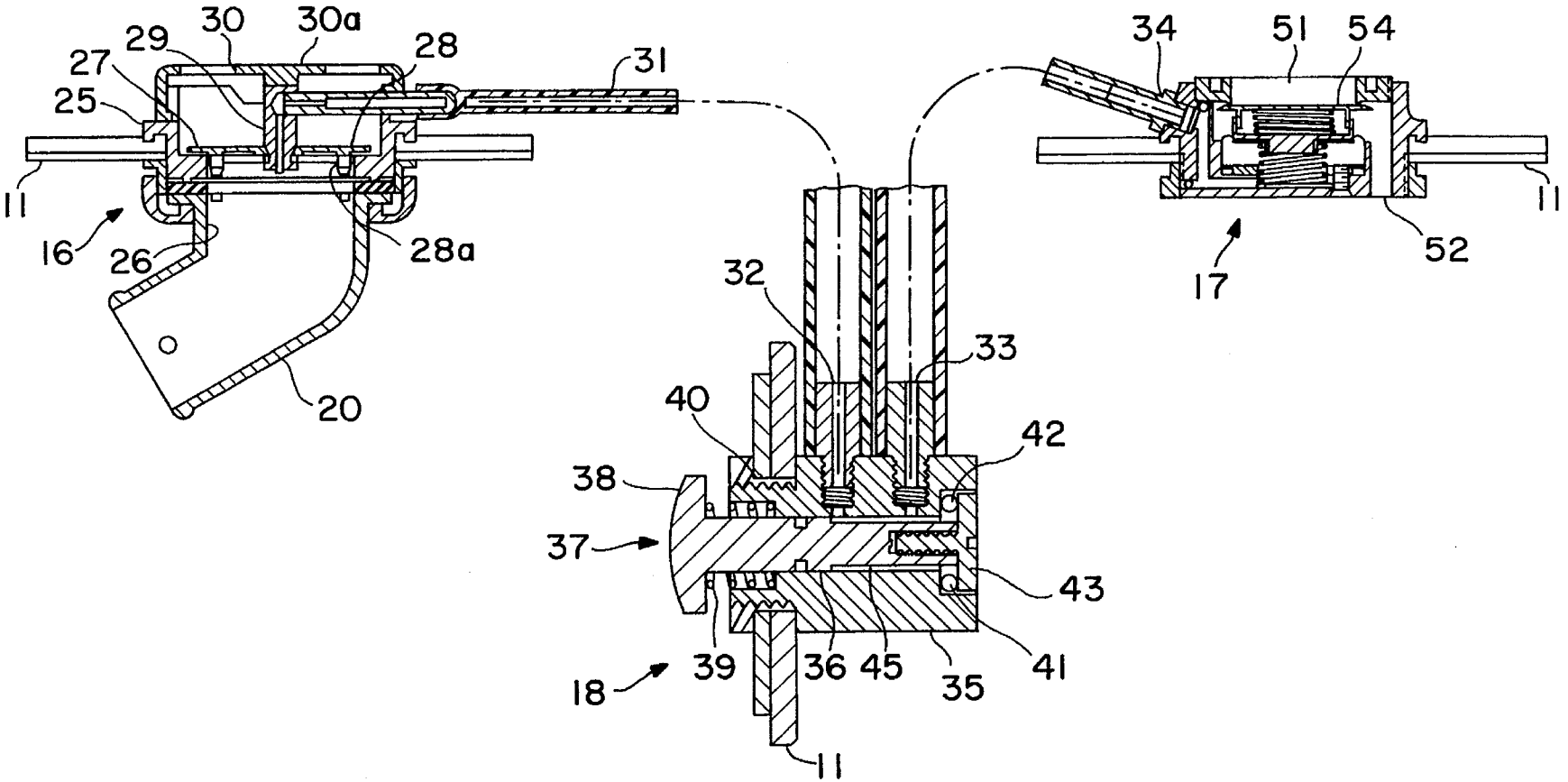
FIG. 2 shows a system, partially in schematic notation, incorporating this invention.

A breathing air supply tube 20 is connected to the inhalation valve to supply a regulated flow of breathing gases to the inhalation valve, and thence to the cavity as shown in FIGS. 1 and 2. Exhalation valve 17 discharges from the cavity to atmosphere.

The inhalation valve and the exhalation valve are both unidirectional check valves, which are suitably responsive to breathing conditions. For example, when the user inhales, he will reduce the pressure in the cavity, and the inhalation valve will open to supply gases for him to breath. At this time, the exhalation valve will be biased closed.

To exhale, the user must exert a muscular effort which will increase the pressure in the cavity. This allows the inhalation valve to close and will open the exhalation valve. This is a routine and well-known pressure breathing system arrangement. In a simplistic arrangement, the user need only occlude the outlet of the exhalation valve to accomplish the Valsalva maneuver. However, as heretofore stated, in the more practical systems the outlet is not conveniently accessible. Also many breathing systems are much more complicated.

As best shown in FIG. 2, inhalation valve 16 has a body 25 with an inlet port 26 to which supply hose 20 is coupled. a circular inlet valve seat 27 co-acts with a flexible flapper 28. The flapper is mounted on a central post 29, held in place by pull thru tabs **28*a* and its free edge moves away from and against valve seat 27 to open and to close the valve. Outlet ports 30 in the attached cover 30*a* extend into the cavity 12**. This is a straight-forward unidirectional check valve dependent on the action of the flapper to permit flow only into the cavity.

The body 11 of the face mask is schematically shown in FIG. 2. Cavity 12 is on the upper side of the inhalation and exhalation valves and to the right of the Valsalva valve in this schematic illustration. Inhalation and exhalation valves may also be located at opposite sides of the cavity 12.

A compensation conduit 31 passes through post 29 from upstream of the flapper. It is connected to a first compensation port 32 in Valsalva valve 18. A second compensation port 33 connects to compensation port 34 in exhalation valve 17.

Valsalva valve 18 has a body 35 with a passage 36 which opens into the breathing cavity when valve poppet 37 is moved inboard. Compensation ports 32 and 33 enter passage 36 at axially spaced-apart locations. Valve poppet 37 fits slidably in passage 36. A button 38 is provided for the user to press to move the poppet when the maneuver is to be accomplished. A bias spring 39 biases the poppet to the left in FIG. 2. An O-ring 40 seals between the poppet and the passage wall.

A seat 41 is provided in the body around the end of the passage where it enters the cavity. A resilient O-ring 42 conveniently forms the sealing surface.

A valve head 43 is placed on the end of the poppet to bear against O-ring 42 which in turn bears against seat 41 when the valve is to be closed to the mask cavity which is the normal position.

A reduced section 45 of the poppet interconnects ports 32 and 33 when the valve head 43 is sealed on seat 41. At that time, pressure from compensation line 31 is communicated to port 34 of the exhalation port to allow normal functioning of exhalation valve 17.

However, reduced section 45 is proportioned so that when the poppet is shifted to unseat the valve head from O-ring 42 and thus open the Valsalva valve to cavity 12, the poppet will have moved to close port 32. As the consequence, compensation port 33 will no longer receive supply line pressure but instead will receive the pressure in the breathing cavity 12, which when the maneuver is being performed, will be higher.

Figure 3:
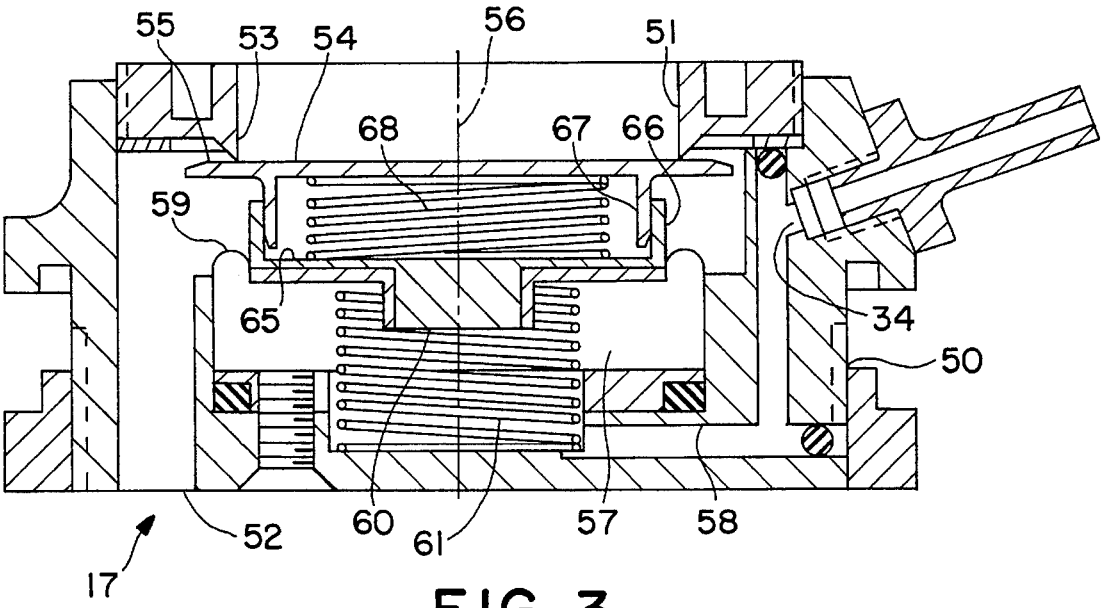
FIG. 3 is an enlarged cross-section of an exhalation valve useful with this invention.

Exhalation valve 17 is shown in greater detail in FIG. 3. It has a body 50 with an inlet port 51 and an outlet port 52. The inlet port opens into the breathing cavity and the outlet port opens to the atmosphere. Obviously if one could manually occlude outlet port 52, the Valsalva maneuver would result. The object of this invention is to attain that result without requiring such manipulation.

A valve seat 53 is formed in the inlet port, and a valve poppet 54 faces it. The poppet has a sealing face 55 which closes the inlet port when it is against the valve seat. The poppet moves along an axis 56.

A compensation chamber 57 is formed internally of a support 58. A rolling diaphragm 59 is anchored to support 58, and to a pilot 60. These close the compensation chamber, and the pilot can move axially. A first bias spring 61 bears against the pilot to press it toward the seat.

The pilot further includes a cup 65 with a rim 66 that slidingly guides a downwardly extending flange 67 from valve poppet 54. A second bias spring 68 is interposed between the valve poppet 54 and the pilot.

The function and construction of the inhalation valve and the exhalation valve will be recognized by persons skilled in this art. It is a conventional pressure breathing system providing compensation for variations in ambient and supply pressures to enable the user routinely to utilize a pressure breathing regimen. When the compensation chamber 57 communicates with the supply pressure (the Valsalva valve being in its normal condition as shown in FIG. 2), the differential pressure necessary from the user to develop by conscious exhalation, is a function of the supply pressure and of the two bias springs.

However, if the poppet in the Valsalva valve is moved to close the compensation passages at port 32 and open the valve at seat 41, pressure within the cavity 12 will be conducted to the compensation chamber 57 of the exhalation valve 17. Now as the user attempts to exhale and thus increase the pressure within the mask cavity this same pressure is communicated to the compensation chamber 57. The effective area of the diaphragm 59 is essentially equal to that of the valve seat 53 and therefore in conjunction with the springs 61 and 68 will force the exhalation valve closed. The harder the user exhales, the tighter the closure will be. Thus the mere pressing of button 38, which can be located at any suitable place, causes the exhalation valve to stay closed, and the Valsalva maneuver will be performed.

This invention is not to be limited by the embodiment shown in the drawings and described in the description, which is given by way of example and not of limitation, but only in accordance with the scope of the appended claims.

I claim:

1. In a pressurized breathing system comprising a face mask defining a breathing cavity adapted to surround a user's nose and mouth, in which an inhalation valve receives breathing gases under supply pressure and supplies them on demand to the cavity, and in which an exhalation valve receives gases from the cavity and discharges them to atmosphere, said inhalation valve and said exhalation valve being unidirectional check valves, said exhalation valve being biased to require muscular effort by the user to raise the cavity to a sufficient pressure to open said exhalation valve, the improvement comprising means to selectively maintain the exhalation valve closed even at pressures above said sufficient pressure, whereby upon exertion of exhalation pressure, the Valsalva maneuver will be accomplished, said means comprising:

said exhalation valve including a seat and an exhalation poppet having a seal, said exhalation poppet being spring-biased toward said seat, and a compensation chamber selectively communicable with said breathing cavity and with said source of gases under supply pressure, said compensation chamber facing said exhalation poppet, pressure in said compensation chamber tending to force the seal toward the seat; and a Valsalva valve comprising a body having a poppet passage, a poppet seat, a poppet, and a poppet seal, connected between said compensation chamber and said cavity, said Valsalva valve selectively preventing and permitting entry of cavity pressure to said compensation chamber such that when said compensation chamber communicates with said source of gasses under supply pressure, the exhalation valve operates normally, but when said compensation chamber communicates with cavity pressure, the exhalation poppet is held closed.

2. Apparatus according to claim 1 in which said poppet of said Valsalva valve includes manually operable and accessible means to move said poppet in said Valsalva valve.

3. A pressurized system comprising:

a face mask defining a breathing cavity adapted to surround a user's nose and mouth;

a source of breathing gases under supply pressure;

a unidirectional inhalation valve connected to said source of breathing gases, said inhalation valve mounted to said mask and having an outlet port opening into said cavity;

a unidirectional exhalation valve comprising a valve body having an inlet port opening into said cavity and an outlet port opening to atmosphere, said inlet port having a seat facing downstream from said inlet port between said inlet port and said outlet port, there being an axially movable poppet seal facing said seat and opening and closing said seat, spring bias means biasing said seal toward said seat, a compensation chamber in said body at an opposite side of said poppet seal from said poppet seat, said axially movable seal means interconnecting said poppet seat and the valve body, said axially movable seal means closing said compensation chamber and enabling the poppet seal to move, and a compensation port through said body opening into said compensation chamber; and a Valsalva valve having a body, a first port connected to said source, a second port connected to said compensation port, a third port opening into said cavity, and valve means for selectively interconnecting said first and second ports in a first valving condition, and to connect said second and third ports in a second valving condition;

the valve means in said first valving condition connecting the source of gases under supply pressure to said compensation chamber and said pressurized system functioning normally, and said valve means in said second valving condition holding the exhalation valve closed and permitting exhalation into the cavity against the closed inhalation and exhalation valves to increase the cavity pressure and accomplish the Valsalva maneuver.

4. A pressurized breathing system according to claim 3 in which said movable seal means in said exhalation valve is a rolling diaphragm.

5. A pressurized breathing system according to claim 5 in which said inlet port of said Valsalva valve is connected to said source through a passage in said inhalation valve which opens into said source ahead of unidirectional check means in said inhalation valve.

6. A pressure breathing system according to claim 3 in which said valve means in the Valsalva valve comprises a valve passage opening into said cavity, said first and second ports opening into said passage at axially spaced apart locations, said third port opening at an end of said passage, and a poppet axially slidable in said passage, said poppet including a head adapted to close said third port in said first condition, and to open it in said second condition, said poppet having channel means which in said first condition interconnects said first and second ports having said third port closed, and in said second condition closing said first port leaving said second port open and opening said third port.

7. A pressure breathing system according to claim 6 in which said movable seal means in said exhalation valve is a rolling diaphragm.

8. A pressurized breathing system according to claim 7 in which said inlet port of said Valsalva valve is connected to said source through a passage in said inhalation valve which opens into said source ahead of unidirectional check means in salad inhalation valve.

* * * * *